US008333502B2

(12) United States Patent
Hiranuma et al.

(10) Patent No.: US 8,333,502 B2
(45) Date of Patent: Dec. 18, 2012

(54) PORTABLE TIMEPIECE

(75) Inventors: Haruki Hiranuma, Chiba (JP); Kazutaka Imai, Chiba (JP)

(73) Assignee: Seiko Instruments Inc. (JP)

( * ) Notice: Subject to any disclaimer, the term of this patent is extended or adjusted under 35 U.S.C. 154(b) by 276 days.

(21) Appl. No.: 12/806,991

(22) Filed: Aug. 25, 2010

(65) Prior Publication Data

US 2011/0051570 A1 Mar. 3, 2011

(30) Foreign Application Priority Data

Aug. 28, 2009 (JP) ..... 2009-198710

(51) Int. Cl.
*G04B 37/00* (2006.01)

(52) U.S. Cl. ..... 368/286; 368/291

(58) Field of Classification Search ..... 368/286–292
See application file for complete search history.

(56) References Cited

U.S. PATENT DOCUMENTS 2,391,803 A * 12/1945 Simon ..... 368/290
3,188,793 A * 6/1965 Morf ..... 368/290
3,525,211 A * 8/1970 Wyssen ..... 368/289
4,783,772 A * 11/1988 Umemoto et al. ..... 368/11
5,257,247 A * 10/1993 Miche et al. ..... 368/290
5,521,890 A * 5/1996 Miche et al. ..... 368/319

OTHER PUBLICATIONS

Patent Abstracts of Japan, publication No. 05-172956, publication date Jul. 13, 1993.

* cited by examiner

*Primary Examiner* — Sean Kayes
(74) *Attorney, Agent, or Firm* — Adams & Wilks

(57) ABSTRACT

A portable timepiece has a timepiece exterior assembly with a button mounting hole having seal surfaces and escape portions. An exhaust button has a shaft portion and a button portion connected to the shaft portion and configured to be pushed inward from an exterior of the assembly. An urging member is provided between the button portion and the assembly for urging the exhaust button toward the exterior of the assembly. Seal members are mounted to the shaft portion in correspondence with the seal surfaces. The seal members undergo movement between a sealing position in which they are held in contact with the respective seal surfaces with interference through axial reciprocation of the exhaust button, and an exhaust position in which the seal members are opposed to the respective escape portions. In the sealing position, the seal members define a closed space formed by the shaft portion and the escape portions.

9 Claims, 5 Drawing Sheets

PORTABLE TIMEPIECE

BACKGROUND OF THE INVENTION

1. Field of the Invention

The present invention relates to a portable timepiece in which, as in the case, for example, of a diver's watch for saturation diving, there is a possibility of the inner pressure of the timepiece exterior assembly being enhanced.

2. Background Information

There is known a diver's watch for saturation diving in which, to cope with the case in which the inner pressure of the timepiece exterior case has become higher than the outer pressure thereof, a button of an exhaust valve provided in this case is intentionally depressed, thereby forcibly discharging the gas inside the timepiece exterior case to the exterior of the case (See, for example, JP-A-5-172956 Patent Document 1).

The exhaust valve with which this diver's watch is equipped has a stepped hole formed in the case band of the timepiece exterior case, a button, a snap ring, a coil spring, and packing.

A small diameter hole portion of the stepped hole is open to the inner side of the case band, and a large diameter hole portion of the stepped hole is open to the exterior of the case band. The button has an operating portion fit-engaged with the large diameter hole portion, and a shaft portion passed through the small diameter hole portion. The snap ring, which prevents detachment of the button from the stepped hole, is connected to the shaft portion inside the timepiece exterior case. The coil spring is accommodated in the large diameter hole portion while wound around the shaft portion, urging the button toward the outer side of the case band. The packing is fixed to the shaft portion. In the normal state, in which the button is not being depressed, this packing exhibits interference while in contact with the inner surface of a pipe attached to the small diameter hole portion or this hole portion; in the state in which the button has been pushed in, it is arranged inside the case band so as not to exhibit any interference.

Thus, simultaneously with the pushing-in of the button, the packing is removed from the small diameter hole portion of the stepped hole; as communication is established between the interior and the exterior of the case band via the stepped hole, it is possible to discharge the gas inside the timepiece exterior case to the exterior of the case via the stepped hole.

The packing of the diver's watch of Patent Document 1 is not compressed by the pressure of the outside air striving to enter the interior from the exterior of the timepiece exterior case, so that, in saturation diving, the airtightness performance of the packing is not enhanced. Thus, the possibility of helium gas used in saturation diving being transmitted through the packing to enter the timepiece exterior case is high; thus, the inner pressure of the case is likely to increase.

Further, in a situation in which the exhaust valve is operated after saturation diving, there is a possibility of water being accumulated in the large diameter hole portion of the stepped hole, and some water adhering to the wet hand of the diver may be allowed to enter the large diameter hole portion. Further, in the case of exhaust valve pushing-in operation under rainy weather, rain water may be allowed to enter the large diameter hole portion. If the exhaust operation is performed in such a situation, there may be a fear of the water in the large diameter hole portion being allowed to enter the timepiece exterior case immediately after the completion of the exhaust, with the packing exhibiting no interference.

As described above, in the prior art technique, gas is likely to be transmitted inside the timepiece exterior case via the exhaust valve from the outside; further, there is a fear of water being allowed to enter from the outside as the degassing operation is completed.

SUMMARY OF THE INVENTION

To solve the above problems, there are provided, according to the portable timepiece of the present invention, a timepiece exterior assembly which is equipped with a button mounting hole having a plurality of seal surfaces and a plurality of escape portions and in which communication is established between the interior and exterior via this mounting hole; an exhaust button equipped with a shaft portion having a detachment preventing portion caught by an edge portion of the button mounting hole from within this timepiece exterior assembly and movably inserted into the button mounting hole, and a button portion connected to this shaft portion and pushed inward from the outside of the timepiece exterior assembly; an urging member provided between the button portion and the timepiece exterior assembly and urging the exhaust button in an anti-pushing-in direction; and a plurality of seal members mounted to the shaft portion in correspondence with the plurality of seal surfaces, moved between a sealing position where they are held in contact with the seal surfaces with interference through axial reciprocation of the exhaust button and an exhaust position where they are opposed to the escape portions, and defining a closed space by the outer periphery of the shaft portion together with the escape portions opposed to this outer periphery while in contact with the seal surfaces.

In the present invention, the diameters of the hole portions formed by the plurality of seal surfaces may be the same with or different from each other, and the diameters of the hole portions formed by the plurality of escape surfaces may be the same with or different from each other. In the present invention, it is desirable for the button mounting hole to be formed by a pipe attached to the timepiece exterior assembly; instead, however, it is also possible to directly form a hole in the case band or the like of the timepiece exterior assembly, using that hole as the button mounting hole. In the present invention, it is desirable for the detachment preventing portion of the exhaust button to be formed integrally with the shaft portion; however, it may also be formed as a member separate from the shaft portion and mounted to the shaft portion. In the present invention, a coil spring may be suitably used as the urging member; however, it may also be a plate spring or the like; further, in the case of a diver's watch, the urging force of this urging member is set to be the same as a designated water pressure such as a saturation diving water pressure. In the present invention, the expression that the seal members "have interference" means a state in which the seal members are held in intimate contact with the seal surfaces while reduced in diameter as compared with the free state.

In the normal state of the portable timepiece of the present invention, the exhaust button is kept in a state in which the detachment preventing portion of the exhaust button is caught by the edge portion of the button mounting hole by the urging of the urging member, and the plurality of seal members are arranged at the sealing positions, each exhibiting interference. In this state, there are formed, in the axial direction of the exhaust button, a plurality of sealing portions where sealing is effected by the seal members, with closed spaces being formed between the seal members adjacent to each other in the axial direction. Thus, in a situation in which a seal member penetrating gas such as helium gas used in saturation diving is transmitted through the seal members, the pressure gradient from the exterior to the interior of the timepiece exterior assembly is reduced stepwise, so that it is possible to mitigate the transmission of gas into the timepiece exterior assembly.

When the exhaust button is moved by the urging force of the urging member such that the seal members move from the exhaust position to the sealing position immediately after the completion of forcible degassing as a result of the user pushing in the exhaust button, some water outside the timepiece exterior assembly may enter the button mounting hole; if so, however, the plurality of seal members will serve as banks, and it is possible to gather the water having entered the button mounting hole in the closed space. At the time of forcible exhaust, the water gathered in the closed space is pushed out by a gas flowing from the interior to the exterior of the timepiece exterior assembly.

A preferred mode of the portable timepiece of the present invention is characterized in that, with the exhaust button being pushed in, an axial first separation distance between the seal member on the outer side of the timepiece exterior assembly of the seal members adjacent to each other in the axial direction of the shaft member and the seal surface where this seal member moves toward and away from, is shorter than an axial second separation distance between the seal member on the inner side of the timepiece exterior assembly of the seal members adjacent to each other and the seal surface where this seal members move toward and away from.

In this mode of the invention, when effecting degassing, due to the difference between the axial first separation distance and the axial second separation distance, the seal member nearer to the interior of the timepiece exterior assembly first reaches the exhaust position from the sealing position; after this, the seal member farther from the interior of the timepiece exterior assembly reaches the exhaust position from the sealing position, and, from this point in time onward, the gas is exhausted to the exterior of the timepiece exterior assembly. Conversely, in the case in which the exhaust button is pushed back by the urging member and restored to the normal state, the seal member farther from the interior of the timepiece exterior assembly first reaches the sealing position from the exhaust position; after this, the seal member nearer to the interior of the timepiece exterior assembly reaches the sealing position from the exhaust position. In this way, the seal is formed by a plurality of seal members so as to exhibit a time difference. As a result, halfway through the process in which the exhaust button is pushed back by the same distance as the proper push-in stroke, it is possible to seal the periphery of the exhaust button by the seal member farther from the interior of the timepiece exterior assembly.

A preferred mode of the portable timepiece of the present invention is characterized in that there are provided, as the seal surfaces, a first seal surface, and a second seal surface situated on the outer side of the timepiece exterior assembly with respect to the first seal surface and forming a hole portion whose hole diameter is smaller than the hole diameter of the hole portion formed by the first seal surface; there are provided, as the escape portions, a first escape portion situated on the inner side of the timepiece exterior assembly with respect to the first seal surface and forming a hole portion whose hole diameter is larger than the hole diameter of the hole portion formed by the first seal surface, and a second escape portion shared by a second-seal-surface-side portion of the first seal surface; the shaft portion has a first shaft portion opposed to the first seal surface and a second shaft portion of a smaller diameter than the first shaft portion and opposed to the second seal surface; and there are provided, as the seal members, a first seal member, and a second seal member of a smaller diameter than the first seal member, the first seal member being attached to a peripheral portion of the first shaft portion, the second seal member being attached to a peripheral portion of the second shaft portion.

In this mode of the invention, there are not provided three or more seal members and seal surfaces, and escape portions in a number corresponding thereto, so that the axial length of the button mounting hole to which the exhaust button is mounted is minimized, making it possible to achieve the object of the present invention while suppressing an increase in the size of the timepiece exterior assembly. Further, the second seal surface is provided on the outer side of the timepiece exterior assembly with respect to the first seal surface, and serves as an entrance for water to the button mounting hole. However, the hole diameter of the hole portion formed by the second seal surface is the minimum diameter of the button mounting hole, so that it is advantageously possible to make it more difficult for water to enter as the degassing is completed.

A preferred mode of the portable timepiece of the present invention is characterized in that the first escape portion has a first tapered surface continuous with the first seal surface, and that the second escape portion has a second tapered surface continuous with the second seal surface.

In this mode of the invention, when machining the first and second seal surfaces and the first and second escape portions on the timepiece exterior assembly, it is possible to machine the large hole portion, more easily by cutting or the like sequentially starting with the small hole portion according to the difference in diameter between the hole portions formed by them, and to smoothly form the interference of the seal members by the guide action due to the tapered surfaces.

A preferred mode of the portable timepiece of the present invention is characterized in that an annular groove for the closed space open to the peripheral surface of the shaft portion is formed between the seal members adjacent to each other in the axial direction of the shaft portion.

In this mode of the invention, it is possible to enlarge the volume of the closed space due to the annular groove, so that even when the amount of water entering from the outside with the completion of degassing is large, it is possible to accumulate it in the closed space, making it advantageously more difficult for water to enter the interior of the timepiece exterior assembly.

A preferred mode of the portable timepiece of the present invention is characterized in that an inclined surface extending from the groove bottom of the annular groove to the outer periphery of the second shaft portion is provided at the second-shaft-portion side groove end portion of the annular groove.

In this mode of the invention, it is advantageously possible to smoothly push out the water accumulated in the annular groove by the gas discharged at the time of gas discharge using the inclined surface of the annular groove as a guide.

A preferred mode of the portable timepiece of the present invention is characterized in that the button mounting hole is formed by a pipe attached to the timepiece exterior assembly, and that the seal surfaces and the escape portions are provided in the inner periphery of this pipe.

In this mode of the invention, the pipe is provided singly, and the seal surfaces and the escape portions can be machined in the inner periphery thereof, so that it is advantageously possible to achieve a more satisfactory machinability as compared with the case in which perforation is directly effected on the case band or the like of the timepiece exterior assembly to provide the button mounting hole.

A preferred mode of the portable timepiece of the present invention is characterized in that the button portion has a cylindrical peripheral wall fit-engaged with a recess formed in the timepiece exterior assembly so as to communicate with the button mounting hole, with a ventilating portion being formed in the cylindrical peripheral wall.

In this mode of the invention, in a degassing state started by the user by forcing the exhaust button to a proper depth where the cylindrical peripheral wall of the exhaust button abuts the bottom of the recess of the timepiece exterior assembly, it is possible to establish communication between the inner space of the cylindrical peripheral wall communicating with the button mounting hole and the fit-engagement gap between the outer periphery of the cylindrical peripheral wall and the inner periphery of the recess via the ventilating portion of the cylindrical peripheral wall. Thus, although the cylindrical peripheral wall abuts the bottom of the recess of the timepiece exterior assembly, there is no break in the degassing route, making it possible to reliably remove the gas inside the timepiece exterior assembly.

A preferred mode of the portable timepiece of the present invention is characterized in that the button portion has an opening cover portion covering the periphery of the opening of the recess and forming an exhaust gap between itself and the periphery of this opening.

In this mode of the invention, at the time of degassing, the gas having passed through the opening along the inner periphery of the recess is emitted through the gap around the opening in a direction orthogonal to the axial direction of the exhaust button, so that it is advantageously possible to suppress the pressure of the discharged gas from acting on the finger of the user depressing the button portion.

According to the present invention, it is possible to provide a portable timepiece which helps to mitigate the transmission of gas into the interior of the timepiece exterior assembly via the periphery of the exhaust button, and in which water is not easily allowed to enter the interior of the timepiece exterior assembly from the outside with the completion of the degassing operation.

DETAILED DESCRIPTION OF THE PREFERRED EMBODIMENT

Figure 1:
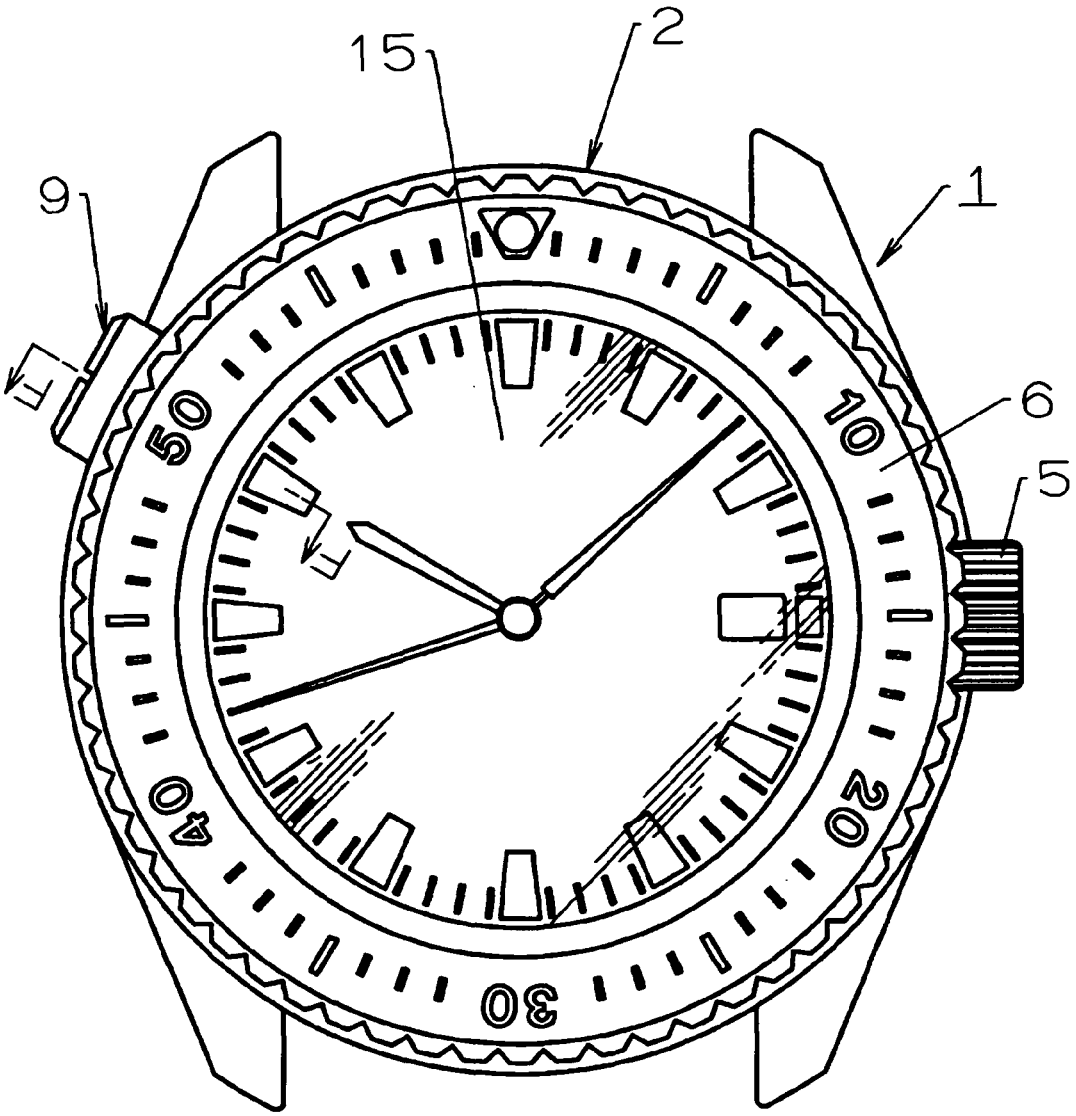
FIG. 1 is a plan view of a wristwatch according to a first embodiment of the present invention.

In the following, the first embodiment of the present invention will be described in detail with reference to FIGS. 1 through 4.

In FIGS. 1 through 4, numeral 1 indicates a portable timepiece, for example, a wristwatch such as a diver's watch also suitable for use in saturation diving. The wristwatch 1 is equipped with a timepiece exterior assembly 2, an exhaust button 31, a plurality of, e.g., two, seal members 41, 42, and an urging member such as a coil spring 45. A pipe 23 constituting a button mounting hole of the timepiece exterior assembly 2 described below, the exhaust button 31, the seal members 41, 42, and the coil spring 45 constitute a degassing valve 9 for reducing the inner pressure of the timepiece exterior assembly 2.

Figure 2:
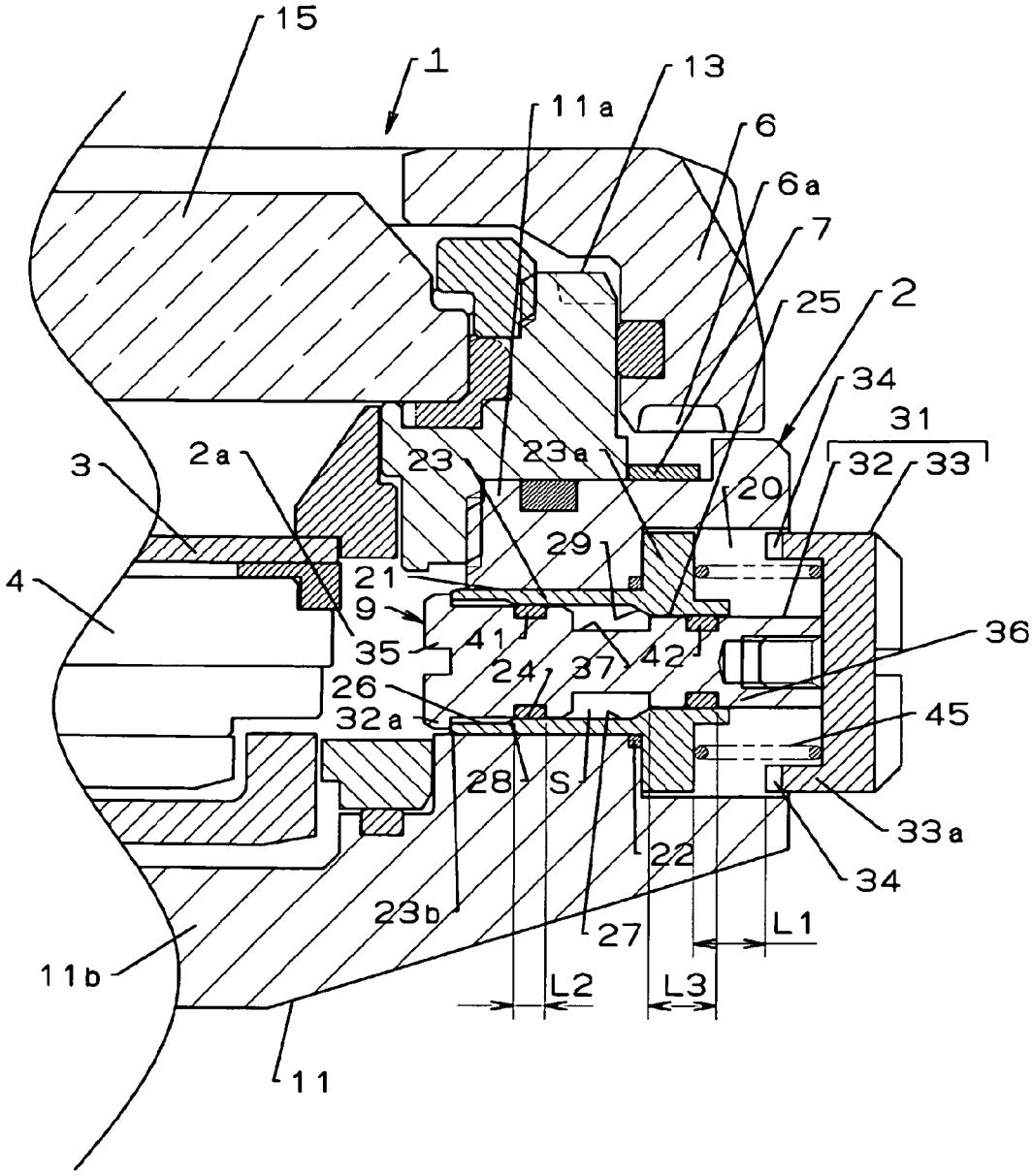
FIG. 2 is a sectional view taken along the line F-F of FIG. 1, showing the wristwatch of the first embodiment in a state prior to degassing via a degassing valve thereof.
Figure 3:
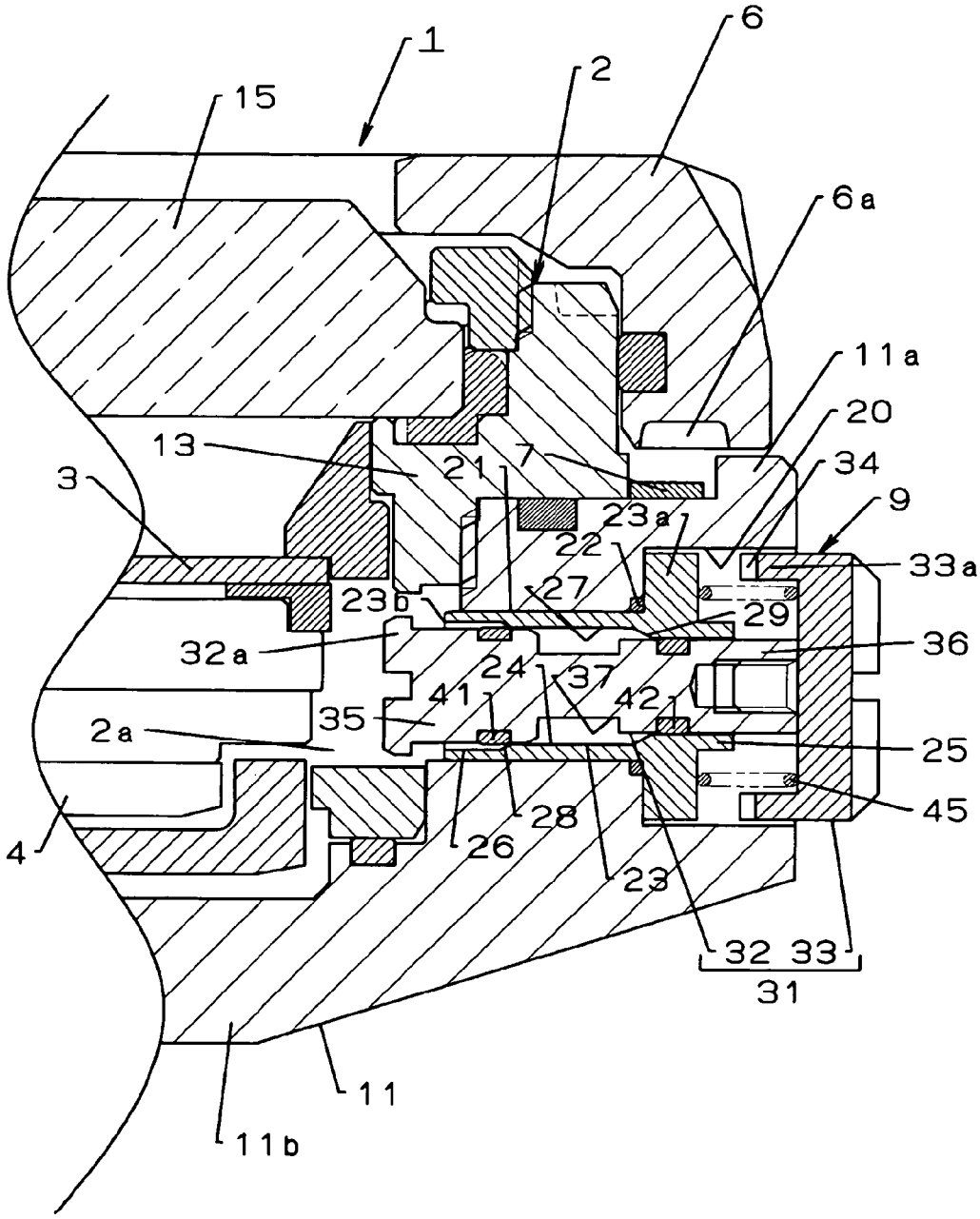
FIG. 3 is a sectional view taken along the line F-F of FIG. 1, showing the wristwatch of the first embodiment halfway through the pushing-in of the degassing valve.
Figure 4:
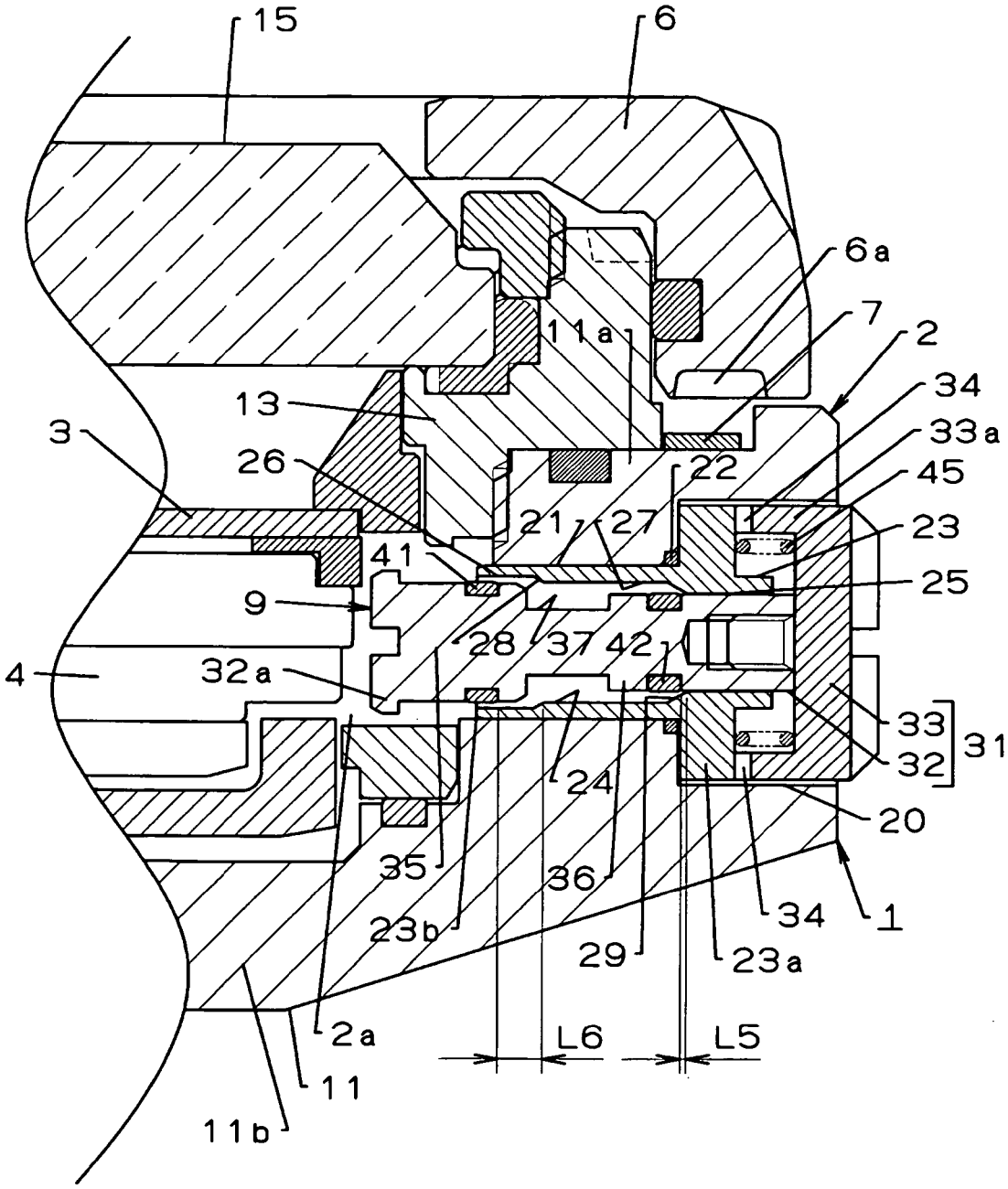
FIG. 4 is a sectional view taken along the line F-F of FIG. 1, showing the wristwatch of the first embodiment in a state in which degassing has been completed via the degassing valve.

As shown in FIGS. 2 through 4, the timepiece exterior assembly 2 contains a time indication plate 3 and a movement 4, and, as shown in FIG. 1, a crown 5 is mounted to the peripheral portion of the timepiece exterior assembly 2.

The timepiece exterior assembly 2 is equipped with a metal exterior member 11 integrally formed by a case band portion 11*a* and a case back portion 11*b*, a glass support member 13, and a cover glass 15. The glass support member 13 is of a ring-like configuration, and is fixed to the case band portion 11*a* by threaded engagement from the front side thereof. The cover glass 15 is attached to the inner side of the glass support member 13 in a liquid-tight fashion, and the back surface thereof is opposed to the time indication plate 3.

Instead of the exterior member 11, it is also possible to adopt a timepiece exterior assembly 2 in which a case band corresponding to the case band portion 11*a* is threadedly engaged with a case back separate therefrom and corresponding to the case back portion 11*b*. Further, mounted to the timepiece exterior assembly 2 is a ring-shaped rotary bezel 6 capable of rotation along the outer periphery of the glass support member 13. The rotary bezel 6 can be kept at rest at an arbitrary rotating position through engagement of a lock member (not shown) of a lock spring 7 with engagement grooves 6*a* (only one of which is shown) provided on the back surface thereof at fixed intervals in the peripheral direction thereof.

As shown in FIGS. 2 through 4, a recess 20 and a pipe passing hole 21 continuous therewith are provided, for example, in the case band portion 11*a* of the timepiece exterior assembly 2. The recess 20 is a round hole, which is open to the outer surface of the timepiece exterior assembly 2, e.g., the outer surface of the case band portion 11*a*. The pipe passing hole 21 is a round hole of a smaller diameter than the recess 20. One end of the pipe passing hole 21 is open to the interior 2*a* of the timepiece exterior assembly 2, and the other end thereof is open to the recess 20.

A pipe 23 consisting of a round metal straight pipe is inserted into the pipe passing hole 21, and the pipe 23 is brazed to the case band portion 11*a* by a brazing material 22. The pipe 23 has at one end portion thereof a flange portion 23*a* protruding integrally from the outer periphery. The flange portion 23*a* covers the bottom surface of the recess 20. The other end portion of the pipe 23 protrudes, for example, into the interior 2*a* of the timepiece exterior assembly 2, and constitutes an edge portion 23*b* of a button mounting hole.

As described above, the pipe 23 is attached to the timepiece exterior assembly 2 to provide the button mounting hole, so that it is possible to machine the seal surfaces and the escape portions described below in the inner periphery thereof, with the pipe 23 being singly provided. Thus, it is possible to achieve a superior machinability as compared with the case in which the button mounting hole is provided by effecting perforation directly on the case band portion 11*a* or the like of the timepiece exterior assembly 2.

The pipe 23 has in its inner periphery a plurality of seal surfaces and a plurality of escape portions continuous therewith. That is, in this embodiment, a first seal surface 24 and a second seal surface 25 are provided in the inner periphery of the pipe 23 so as to be spaced apart from each other in the axial direction of the pipe 23, and a first escape portion 26 and a second escape portion 27 are provided in the inner periphery of the pipe 23 so as to be spaced apart from each other in the axial direction of the pipe 23.

The second seal surface 25 is formed in the inner periphery of one end portion of the pipe 23, and the first escape portion 26 is formed in the inner periphery of the other end portion of the pipe 23. The first seal surface 24 and the second escape portion 27 are formed by the same component. That is, the second escape portion 27 is formed by the second-seal-surface-25-side portion of the first seal surface 24. Thus, the first seal surface 24 also serving as the second escape portion 27 is situated between the second seal surface 25 and the first escape portion 26 and is formed in the inner periphery of the pipe 23. Thus, the first seal surface 24, the first escape portion 26, the second seal surface 25, and the second escape portion 27 are provided so as to be alternately arranged in that order in the axial direction of the pipe 23.

The hole diameter of the hole portion formed by the second seal surface 25 and the first escape portion 26 is smaller than the hole diameter of the hole portion formed by the first seal surface 24. The first escape portion 26 has a first tapered surface 28 continuous with the first seal surface 24. Thus, the hole diameter of the hole portion formed by the first escape portion 26 continuous with the interior 2*a* side of the timepiece exterior assembly 2 with respect to the first seal surface 24 is larger than the hole diameter of the hole portion formed by the first seal surface 24. The hole portion formed by the first escape portion 26 is open to the interior 2*a* of the timepiece exterior assembly 2.

Similarly, the second escape portion 27 has a second tapered surface 29 continuous with the second seal surface 25. Thus, the hole diameter of the hole portion formed by the second escape portion 27 continuous with the interior 2*a* side of the timepiece exterior assembly 2 with respect to the second seal surface 25 is larger than the hole diameter of the hole portion formed by the second seal surface 25.

As described above, the first escape portion 26 and the first seal surface 24 are continuous with each other via the first tapered surface 28, and the second tapered portion 27 and the second seal surface 25 are continuous with each other via the second tapered surface 29, so that the inner diameter of the pipe 23 increases stepwise from one end on the case band exterior (the exterior of the timepiece exterior assembly 2) side of the pipe 23 toward the case band interior side (the interior 2*a* side).

Due to this difference in hole diameter, when machining the first seal surface 24, the first escape portion 26, the second seal surface 25, and the second escape portion 27 on the pipe 23 of the timepiece exterior assembly 2, it is possible to perform the machining sequentially by cutting or the like in ascending order of hole diameter. Thus, the pipe 23 constituting the button mounting hole advantageously exhibits satisfactory machinability.

Further, when an exhaust button 31 described below is pushed back toward the case band exterior side by the coil spring 45, the movement is advantageously smooth. That is, as the exhaust button 31 is pushed back, it is possible to suppress, due to the first tapered surface 28, a first seal member 41 described below from being caught when entering the hole portion formed by the first seal surface 24. At the same time, it is possible to insert the first seal member 41, using the first tapered surface 28 as a guide, into the hole portion formed by the first seal surface 24 while causing it to smoothly undergo elastic deformation so as exhibit interference.

Similarly, as the exhaust button 31 is pushed back toward the case band exterior side, it is possible to suppress, due to the second tapered surface 29, the second seal member 42 described below from being caught when entering the hole portion formed by the second seal surface 25. At the same time, using the second tapered surface 29 as a guide, it is possible to insert the second seal member 42 into the hole portion formed by the second seal surface 25 while causing it to smoothly undergo elastic deformation so as to exhibit interference.

The exhaust button 31 is equipped with a shaft portion 32 and a button portion 33 connected thereto.

The outer periphery of the shaft portion 32 is round, and the shaft portion 32 is inserted into the pipe 23 from the interior 2*a* of the timepiece exterior assembly 2. The shaft portion 32 is movable in the axial direction of the pipe 23, and has a detachment preventing portion 32*a* at the end portion thereof on side of the interior 2*a* of the timepiece exterior assembly 2. The detachment preventing portion 32*a* protrudes integrally from the outer periphery of the above-mentioned end portion, and can move toward and away from the edge portion 23*b*, preventing further movement and detachment of the exhaust button 31 from the pipe 23 to the exterior of the timepiece exterior assembly 2 through contact therewith, that is, getting caught thereby.

The button portion 33 has a cylindrical peripheral wall 33*a* of a size suitable for fit-engagement with the recess 20. A screw portion protrudes integrally from the center of the back surface of the button portion 33, and the shaft portion 32 is threadedly engaged with this screw portion, whereby the exhaust button 31 is assembled. To enable this assembly, there is formed, at each of the end portion of the shaft portion 32 on the side of the interior 2*a* of the timepiece exterior assembly 2 and the button portion 33, a groove to be engaged with a tool (not shown) for turning the shaft portion 32 and the button portion 33.

The cylindrical peripheral wall 33*a* has a ventilating portion 34 establishing communication between the interior and the exterior of the cylindrical peripheral wall 33*a*. There are provided a plurality of ventilating portions 34 at peripheral intervals in the cylindrical peripheral wall 33*a*. The ventilating portions 34 are provided, for example, so as to be open in the peripheral end surface of the cylindrical peripheral wall 33*a* directed to the bottom of the recess 20. The peripheral end surface of the cylindrical peripheral wall 33*a* can abut a flange portion 23*a* substantially constituting the bottom of the recess 20 through pushing-in of the button portion 33. Through this abutment, the pushing-in depth of the exhaust button 31 can be properly determined.

The shaft portion 32 has a first shaft portion 35, a second shaft portion 36, and an annular groove 37. The first shaft portion 35 is formed by the detachment preventing portion 32*a* side portion of the shaft portion 32. The second shaft portion 36 is formed by the button portion 33 side portion of the shaft portion 32. The annular groove 37 is formed at the shaft portion between the first shaft portion 35 and the second shaft portion 36 so as to be open in the outer periphery thereof.

The diameter of the first shaft portion 35 is of a size suitable for fit-engagement with the hole portion formed by the first seal surface 24, and is smaller than the hole diameter of the hole portion formed by the first escape portion 26. The diameter of the second shaft portion 36 is smaller than the diameter of the first shaft portion 35. Further, the diameter of the second shaft portion 36 is of a size suitable for fit-engagement with the hole portion formed by the second seal surface 25, and is smaller than the hole diameter of the hole portion formed by the first seal surface 24 serving also as the second escape portion 27.

The seal members 41, 42 are formed in a ring-like configuration of an elastic material such as synthetic rubber or elastomer. The first seal member 41, which is one of the seal members 41, 42, is fit-engaged with an annular seal groove formed in the peripheral portion of the first shaft portion 35 and is attached thereto. The outer peripheral diameter of the first seal member 41 in its free state is larger than the hole diameter of the hole portion formed by the first seal surface 24, and is smaller than the hole diameter of the hole portion formed by the first escape portion 26. The second seal member 42, which is the other of the seal members 41, 42, is fit-engaged with an annular seal groove formed in the peripheral portion of the second shaft portion 36 and is attached thereto. The second seal member 42 is of a smaller diameter than the first seal member 41. Further, the outer peripheral diameter of the seal member 42 in its free state is larger than the hole diameter of the hole portion formed by the second seal surface 25, and smaller than the hole diameter of the hole portion formed by the first seal surface 24 serving also as the second escape portion 27.

The coil spring 45 is provided in a compressed state between the button portion 33 and the timepiece exterior assembly 2 (more specifically, the flange portion 23*a* of the pipe 23 constituting the bottom of the recess 20). The exhaust button 31 is urged by the urging force of the coil spring 45 in the anti-pushing-in direction, that is, toward the exterior of the timepiece exterior assembly 2. As shown in FIG. 2, due to this urging, the exhaust button 31 is maintained in the state in which the detachment preventing portion 32*a* is kept caught by the edge portion 23*b* of the pipe 23, and the button portion 33 is maintained in a state in which the button portion 33 protrudes outwardly from the opening of the recess 20 except for the peripheral end surface side portion of the cylindrical peripheral wall 33*a* of the button portion 33. The coil spring 45 has a spring force (urging force) corresponding to the designated pressure of the saturation diving.

In the normal state of the wristwatch 1 shown in FIG. 2, of the seal members 41, 42 adjacent to each other in the axial direction of the exhaust button 31, the first seal member 41 arranged relatively nearer to the interior of the timepiece exterior assembly 2 is slidably held in intimate contact with the first seal surface 24 while elastically deformed, that is, while exhibiting interference. At the same time, of the seal members 41, 42 adjacent to each other in the axial direction of the exhaust button 31, the second seal member 42 arranged relatively nearer to the exterior of the timepiece exterior assembly 2 is slidably held in intimate contact with the second seal surface 25 while elastically deformed, that is, while exhibiting interference.

Here, when the first seal member 41 and the second seal member 42 are thus arranged while exhibiting interference, they are regarded as arranged at sealing positions. When they are arranged at the sealing positions, the first seal member 41 and the second seal member 42 define a closed space S together with the outer periphery of the shaft portion 32 between them and the second escape portion 27 opposed to this outer periphery. The annular groove 37 is opposed to the closed space S, whereby there is formed the closed space S inclusive of the annular groove 37.

Further, as shown in FIG. 2, when the proper pushing-in stroke of the exhaust button 31 is L1, the first seal member 41 arranged at the sealing position is situated within a distance L2 less than ½ of the stroke on the button portion 33 side with respect to the first escape portion 26 side end of the first seal surface 24, and is held in intimate contact with the first seal surface 24. Similarly, the second seal member 42 arranged at the sealing position is situated within a distance L3 not less than ½ of the stroke and less than 1 stroke on the button portion 33 side with respect to the second escape portion 27 side end of the second seal surface 25, and is held in intimate contact with the second seal surface 25.

In the state in which the wristwatch 1 is being carried about, the first seal member 41 and the second seal member 42 are arranged, as described above, at the sealing positions while exhibiting interference. Thus, there are formed a plurality of (two) sealing portions by these seal members in the axial direction of the exhaust button 31, and there is formed the closed space S between the sealing portions adjacent to each other in the axial direction of the exhaust button 31.

In saturation diving, a seal member penetrating gas such as helium gas used in an under-water residential area is transmitted through the portion of the seal member around the cover glass 15 and the portion of the seal member around the exhaust button 31, so that the gas pressure within the timepiece exterior assembly 2 is enhanced.

In this case, regarding the areas around the exhaust button 31, they are respectively sealed by the first seal member 41 and the second seal member 42 provided at an interval in the axial direction of the exhaust button 31, so that the pressure gradient from the exterior to the interior of the timepiece exterior assembly 2 is reduced stepwise. That is, the gas pressure within the recess 20, which is equal to the gas pressure of the under-water residential area, is the highest, and the pressure in the closed space S defined by the first seal member 41 and the second seal member 42 is the second highest, and the pressure within the interior 2*a* of the timepiece exterior assembly 2 is the lowest.

Thus, the difference in gas pressure between the recess 20 and the closed space S is small, whereby the transmission of helium gas through the second seal member 42 is mitigated. Similarly, the difference in gas pressure between the closed space S and the interior 2*a* of the timepiece exterior assembly 2 is small, whereby the transmission of helium gas through the first seal member 41 is mitigated. In this way, the transmission of gas via the area around the exhaust button 31 is mitigated, so that it is possible to suppress an increase in the inner pressure of the timepiece exterior assembly 2.

After a user has risen to the surface of the water from the under-water residential area, the user pushes in the exhaust button 31 while further compressing the coil spring 45 of the degassing valve 9, whereby the gas within the interior 2*a* of the timepiece exterior assembly 2 is forcibly discharged to the exterior.

FIG. 3 shows a state in which, in this degassing, the exhaust button 31 is halfway through the pushing-in, e.g., a state in which the exhaust button 31 has been pushed in by substantially ½ of the proper pushing-in stroke L1 of the exhaust button 31 when the exhaust button 31 is properly depressed.

In this state, the second seal member 42 nearer to the exterior of the timepiece exterior assembly 2 is held in intimate contact with the second seal surface 25 still exhibiting interference, whereas the first seal member 41 nearer to the interior 2*a* of the timepiece exterior assembly 2 is detached from the first seal surface 24, and is opposed to the first escape portion 26. Thus, the first seal member 41 has been restored to the free state in which there is no interference, and the closed space S is open to the gap formed between the first seal member 41 and the first escape portion 26. Thus, via this gap, the pressure between the first seal member 41 and the second seal member 42 is made equal to the pressure in the interior 2*a* of the timepiece exterior assembly 2.

FIG. 4 shows a state in which the proper pushing-in of the exhaust button 31 has been completed, that is, a state in which the exhaust button 31 has been moved by the proper pushing-in stroke L1, and in which the peripheral end surface of the cylindrical peripheral wall 33*a* of the button portion 33 abuts the flange portion 23*a* constituting the bottom of the recess 20. When the exhaust button 31 is thus properly pushed in, the second seal member 42 is detached from the second seal surface 25, and is opposed to the second escape portion 27. Also in this state, the first seal member 41 is opposed to the first escape portion 26.

In this state, an axial first separation distance L5 between the second seal member 42 nearer to the exterior of the timepiece exterior assembly 2 and the second seal surface 25 toward and away from which it moves, is shorter than an axial second separation distance L6 between the first seal member 41 nearer to the interior 2*a* of the timepiece exterior assembly 2 and the first seal surface 24 toward and away from which it moves. That is, here, when both the first seal member 41 and the second seal member 42 are arranged so as to be opposed to the corresponding escape portions, the first seal member 41 and the second seal member 42 are regarded as arranged at the exhaust positions.

Due to this arrangement, the second seal member 42 is restored to the free state in which it exhibits no interference, and the space between the first seal member 41 and the second seal member 42 communicates with the recess 20 of the timepiece exterior assembly 2 via the gap formed between the second seal member 42 and the second escape portion 27.

As described above, as the exhaust button 31 is pushed in, the first seal member 41 nearer to the interior 2*a* of the timepiece exterior assembly 2 first reaches the exhaust position from the sealing position thereof (See the state of FIG. 3). After this, the second seal member 42 farther from the interior 2*a* of the timepiece exterior assembly 2 reaches the exhaust position from the sealing position thereof (See the state of FIG. 4).

Thus, from this point in time onward, the gas within the timepiece exterior assembly 2 flows out into the recess 20 via the area around the exhaust button 31, and flows from the recess 20 by way of the ventilating portion 34 of the button portion 33; and, further, it is discharged to the exterior of the timepiece exterior assembly 2 via the fit-engagement gap between the outer periphery of the cylindrical peripheral wall 33*a* of the button portion 33 and the inner periphery of the recess 20.

In this case, although the forward end of the cylindrical peripheral wall 33*a* abuts the bottom of the recess 20 as described above, the degassing route is secured without a break due to the ventilating portions 34, so that it is possible to reliably remove the gas within the interior 2*a* of the timepiece exterior assembly 2. And, when, as a result of this degassing, water is accumulated in the closed space S as described below, it is possible to push the water out of the closed space S due to the gas flow discharged to the exterior from the interior 2*a* of the timepiece exterior assembly 2.

As described above, at the same time that the degassing is completed and the pushing-in of the exhaust button 31 is released, the exhaust button 31 is pushed back toward the exterior of the timepiece exterior assembly 2 by the spring force of the coil spring 45, so that each of the first seal member 41 and the second seal member 42 is moved from the exhaust position to the sealing position, and the normal state as shown in FIG. 2 is restored.

When the exhaust button 31 is thus moved by the coil spring 45 such that the first seal member 41 and the second seal member 42 move from the exhaust positions to the sealing positions, it can happen that the water having entered the recess 20 by that time strives to enter the pipe 23 constituting the button mounting hole. In this case, each of the first seal member 41 and the second seal member 42 serves as a bank, so that it is difficult for the water having entered the pipe 23 to reach the interior 2*a* of the timepiece exterior assembly 2.

At this time, it is possible to accumulate the water having gotten over the second seal member 42 in the closed space S being formed. As a result, it is possible to suppress more reliably intrusion of water into the interior 2*a* of the timepiece exterior assembly 2. Further, a large volume is secured for the closed space S due to the annular groove 37 facing the same. Thus, even when the intrusion amount of water at the time of completion of the degassing is large, the water is accumulated in the closed space S, so that it is possible to make it more difficult for the water to get over the first seal member 41 and enter the interior 2*a* of the timepiece exterior assembly 2.

Further, when the exhaust button 31 is pushed back by the coil spring 45 and restored to the normal state upon completion of the above degassing, due to the difference between the axial first separation distance L5 and the axial second separation distance L6, the second seal member 42 farther from the interior 2*a* of the timepiece exterior assembly 2 first reaches the sealing position from the exhaust position thereof. After this, the first seal member 41 nearer to the interior 2*a* of the timepiece exterior assembly 2 reaches the sealing position from the exhaust position thereof.

In this way, the seal is formed by a plurality of seal members 41, 42 with a difference in time. As a result, before the exhaust button 31 is pushed back by the same distance as the proper pushing-in stroke L1, for example, at an early stage from the start of the movement of the exhaust button 31 to the exterior of the timepiece exterior assembly 2, there is attained a state in which the second seal member 42 farther from the interior 2*a* of the timepiece exterior assembly 2 is arranged at the sealing position to exhibit interference. Thus, in this regard, it is possible to make it difficult for the water outside the timepiece exterior assembly 2 to enter the interior 2*a* of the timepiece exterior assembly 2 through the pipe 23 constituting the button mounting hole.

In the first embodiment described above, there are not provided three or more seal members and a corresponding number of seal surfaces and escape portions, so that, as the axial length of the pipe 23 to which the exhaust button 31 is mounted is minimized, it is possible to suppress an increase in the size of the timepiece exterior assembly 2. Further, the hole diameter of the hole portion formed by the second seal surface 25, which is provided on the outer side of the timepiece exterior assembly 2 with respect to the first seal surface 24 and constitutes the intrusion entrance for water into the pipe 23, is the minimum of the pipe 23, so that intrusion of water at the time of completion of degassing becomes more difficult.

Figure 5:
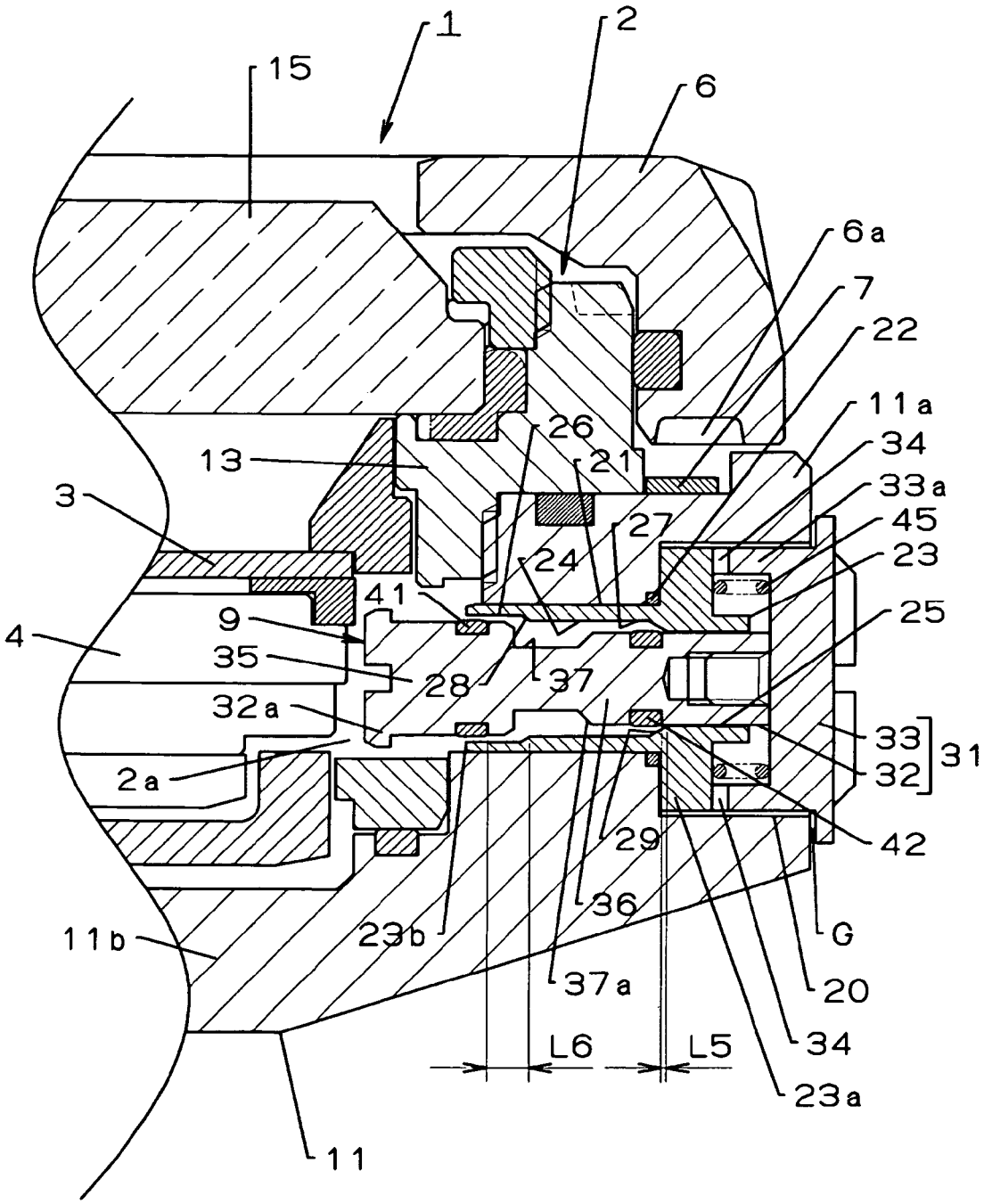
FIG. 5 is a sectional view of a wristwatch according to a second embodiment of the present invention in a state in which degassing has been completed via a degassing valve thereof.

The second embodiment of the present invention will be described with reference to FIG. 5. Except for the matter described below, the second embodiment is the same as the first embodiment, so the components that are the same as those of the first embodiment are indicated by the same reference numerals, and a description thereof will be omitted.

In the second embodiment, the annular groove 37 formed in the shaft portion 32 of the exhaust button 31 has an inclined surface 37*a* at the second shaft portion 36 side groove end portion continuous with the annular groove 37. The inclined surface 37*a* is provided over the outer periphery of the second shaft portion 36 continuous with the annular groove 37 from the groove bottom of the annular groove 37. In this construction, the annular groove 37 has on the second shaft portion 36 side no end surface perpendicular to the groove bottom of the annular groove 37. Thus, it is possible to smoothly push the water accumulated in the annular groove 37 out of the annular groove 37 by the gas discharged at the time of degassing, using the inclined surface 37*a* as a guide.

Further, in the second embodiment, the button portion 33 has an opening cover portion 33*b*. The opening cover portion 33*b* is opposed to the periphery of the opening of the recess 20, and is, for example, of a flange-like configuration. The opening cover portion 33*b* is provided so as to cover the periphery of the opening of the recess 20 and to form an exhaust gap G between itself and the periphery of the opening, with the exhaust button 31 properly pushed in.

Due to the provision of the opening cover portion 33*b*, it is possible, at the time of forcible degassing, to discharge the gas having passed through the opening along the inner periphery of the recess 20 in a direction orthogonal to the axial direction of the exhaust button 31 through the gap G around this opening. Due to this control of the exhaust direction, it is possible to suppress the pressure of the discharged gas from acting on the finger of the user depressing the button portion 33.

Except for the matter described above, the portable timepiece 1 of the second embodiment is of the same construction as the first embodiment. Thus, in the second embodiment also, it is possible to attain the object of the present invention for the reason already stated with respect to the first embodiment.

What is claimed is:

1. A portable timepiece comprising:

a timepiece exterior assembly having a button mounting hole establishing communication between an interior and an exterior of the timepiece exterior assembly, the button mounting hole having a plurality of seal surfaces and a plurality of escape portions;

an exhaust button having a shaft portion and a button portion, the shaft portion having a detachment preventing portion configured to be caught by an edge portion of the button mounting hole from within the timepiece exterior assembly and being movably inserted into the button mounting hole, and the button portion being connected to the shaft portion and configured to be pushed inward from the exterior of the timepiece exterior assembly;

an urging member provided between the button portion of the exhaust button and the timepiece exterior assembly for urging the exhaust button toward the exterior of the timepiece exterior assembly; and a plurality of seal members mounted to the shaft portion of the exhaust button in correspondence with the plurality of seal surfaces of the button mounting hole, the plurality of seal members being configured to undergo movement between a sealing position in which the plurality of seal members are held in contact with the respective seal surfaces with interference through axial reciprocation of the exhaust button and an exhaust position in which the plurality of seal members are opposed to the respective escape portions, the plurality of seal members defining in the sealing position thereof a closed space formed by the outer periphery of the shaft portion together with the escape portions opposed to the outer periphery of the shaft portion.

2. A portable timepiece according to claim 1; wherein the plurality of seal members comprise first and second seal members disposed adjacent to each other in the axial direction of the shaft portion, the first and second seal members being arranged on inner and outer sides, respectively, of the timepiece exterior assembly; and wherein when the exhaust button is pushed in toward the interior of the timepiece exterior assembly, an axial first separation distance between the second seal member and the corresponding seal surface of the second seal member is shorter than an axial second separation distance between the first seal member and the corresponding seal surface of the first seal member.

3. A portable timepiece according to claim 1; wherein the plurality of seal surfaces comprise a first seal surface arranged on an inner side of the timepiece exterior assembly and a second seal surface arranged on an outer side of the timepiece exterior assembly, each of the first and second seal surfaces forming a hole portion with the hole portion formed by the second seal surface having a hole diameter smaller than that of the hole portion formed by the first seal surface; wherein the plurality of escape portions comprise a first escape portion arranged on the inner side of the timepiece exterior assembly with respect to the first seal surface and forming a hole portion whose hole diameter is larger than the hole diameter of the hole portion formed by the first seal surface, and a second escape portion shared by a second-seal-surface-side portion of the first seal surface; wherein the shaft portion of the exhaust button has a first shaft portion opposed to the first seal surface and a second shaft portion of a smaller diameter than the first shaft portion and opposed to the second seal surface; and wherein the plurality of seal members comprise a first seal member and a second seal member of a smaller diameter than the first seal member, the first seal member being attached to a peripheral portion of the first shaft portion and the second seal member being attached to a peripheral portion of the second shaft portion.

4. A portable timepiece according to claim 3; wherein the first escape portion has a first tapered surface continuous with the first seal surface, and that the second escape portion has a second tapered surface continuous with the second seal surface.

5. A portable timepiece according to claim 1; further comprising an annular groove formed in the outer periphery of the shaft portion and between the seal members so as to oppose the closed space.

6. A portable timepiece according to claim 5; wherein the shaft portion comprises a first shaft portion and a second shaft portion with the annular groove disposed therebetween; and further comprising an inclined surface extending from a bottom of the annular groove to an outer periphery of the second shaft portion.

7. A portable timepiece according to claim 1; wherein the button mounting hole is formed by a pipe attached to the timepiece exterior assembly, the plurality of seal surfaces and the plurality of escape portions being provided in an inner periphery of the pipe.

8. A portable timepiece according to claim 1; wherein the button portion of the exhaust button has a cylindrical peripheral wall fit-engaged with a recess formed in the timepiece exterior assembly so as to communicate with the button mounting hole, a ventilating portion being formed in the cylindrical peripheral wall.

9. A portable timepiece according to claim 8; wherein the button mounting hole communicates with a recess that opens to an outer surface of the timepiece exterior assembly; and wherein the button portion has an opening cover portion covering a periphery of an opening of the recess so as to form an exhaust gap between the opening cover portion and the periphery of the opening of the recess.

* * * * *